US006231331B1

(12) United States Patent
Lievers

(10) Patent No.: US 6,231,331 B1
(45) Date of Patent: May 15, 2001

(54) VIBRATORY SCREED DEVICE FOR LEVELLING FRESHLY POURED CONCRETE SURFACES

(75) Inventor: Johannes Franciscus Lievers, Vinkeveen (NL)

(73) Assignee: Bouwmachinefabriek Lievers B.V., Abcoude (NL)

( * ) Notice: Subject to any disclaimer, the term of this patent is extended or adjusted under 35 U.S.C. 154(b) by 0 days.

(21) Appl. No.: 09/210,391

(22) Filed: Dec. 14, 1998

(30) Foreign Application Priority Data

Oct. 19, 1998 (NL) ..... 1010349

(51) Int. Cl.[7] ..... E01C 19/40

(52) U.S. Cl. ..... 425/183; 425/456; 404/114; 404/118

(58) Field of Search ..... 425/456, 470, 425/472, 182, 183; 404/97, 102, 114, 115, 118, 119

(56) References Cited

U.S. PATENT DOCUMENTS 4,591,291 * 5/1986 Owens ..... 404/118
4,856,835 * 8/1989 Pacione ..... 294/61
5,244,305 * 9/1993 Lindley ..... 404/97
5,375,286 * 12/1994 Harrah ..... 15/147.1
5,375,942 12/1994 Lindley et al. ..... 404/97
5,388,338 * 2/1995 Majors ..... 33/376
5,460,461 * 10/1995 McGrath ..... 404/118
5,528,791 * 6/1996 Wilson ..... 15/119.2
5,540,519 * 7/1996 Weber ..... 404/102
5,980,154 * 11/1999 Record ..... 404/97

* cited by examiner

*Primary Examiner*—Robert Davis
*Assistant Examiner*—Joseph S. Del Sole
(74) *Attorney, Agent, or Firm*—Young & Thompson

(57) ABSTRACT

A vibratory screed device for levelling freshly poured concrete surfaces consists of an elongated vibrated screed beam delimited by a flat underside, a first and a second longitudinal side and a top; of a vibratory assembly for bringing the vibrated screed beam into vibration; and of a handle assembly which can be fixed in a detachable manner to the vibrated screed beam at an upward slope with respect to the flat underside. The first and the second longitudinal side are differently profiled and each has a surface suitable for vibratory levelling. The handle assembly can be fixed to the vibrated screed beam in two positions, in the one position sloping upwards obliquely at the first longitudinal side in order to make the first longitudinal side the active surface and in the second position sloping upwards obliquely at the second longitudinal side in order to make the second longitudinal side the active surface. The second and the first longitudinal side are in particular profiled differently to one another such that they form surfaces which act in a different way to one another.

8 Claims, 1 Drawing Sheet

VIBRATORY SCREED DEVICE FOR LEVELLING FRESHLY POURED CONCRETE SURFACES

FIELD OF THE INVENTION

The present invention relates to a vibratory screed device for levelling freshly poured concrete surfaces, comprising:

- an elongated vibrated screed beam delimited by a flat underside, a first and a second longitudinal side and a top;
- a vibratory assembly for bringing the vibrated screed beam into vibration; and
- a handle assembly which is fixed, or can be fixed, in a detachable manner, to the vibrated screed beam at an upward slope with respect to the flat underside and essentially transversely to the vibrated screed beam.

BACKGROUND OF THE INVENTION

A vibratory screed device of this type is disclosed, for example, in US Patent U.S. Pat. No. 5,540,519. This publication discloses a vibratory screed device having an elongated vibrated screed beam which in cross-section is in the shape of an equilateral triangle. The vibrated screed beam is delimited by a flat underside, the first side of the triangle, by a first and second longitudinal side, the first and second sides of the triangle, and a top, specifically the apex or rib of the triangle. Furthermore, a handle assembly is provided which can be fitted, such that in principle it can be detached, on the vibrated screed beam, in particular on one of the longitudinal sides, such that it then slopes upwards with respect to the flat underside, transversely to the vibrated screed beam. A vibratory motor is fitted in the handle assembly, which motor transmits vibrations to the vibrated beam via a driven shaft and a vibratory rod fitted in the vibrated screed beam. Incidentally, it is pointed out that the installation based on the said patent which is available on the market has a different vibratory assembly without the vibratory rod fitted in the vibrated screed beam. In the case of the version obtainable on the market, the vibrations are transmitted to the outside of the vibrated screed beam from a vibration source fitted on the handle assembly.

As such, vibratory screed devices for levelling freshly poured concrete surfaces have already been known for several decades. In this context a very large number of vibrated screed beams of different constructions have already been designed for diverse specific applications. In general the requirements in respect of a vibrated screed beam for relatively wet concrete differ from those for relatively dry concrete. A further point is that vibratory screed devices of this type can be used in a manner in which they float on the concrete, but can also be used in a supported manner, in which case road forms, on which the ends of the vibrated screed beam bear, are placed at the side of the concrete surface or in the concrete surface. The intention with all of these vibratory screed devices is to level freshly poured concrete surfaces and, in doing so, also to compact the concrete by means of vibration. Depending on the specific application, a different vibratory screed device or at least a different vibrated screed beam must therefore always be used. This means that a number of different types of vibratory screed devices or at least a number of different types of vibrated screed beams must be kept in stock. There are manufacturers who respond to this by marketing various types of vibrated screed beams.

SUMMARY OF THE INVENTION

The aim of the present invention is, now, to provide a vibratory screed device of the type specified in the preamble which can be used for more than one specific application, and in particular to provide a relatively universal vibratory screed device.

The aim is achieved with a vibratory screed device of the type specified in the preamble in that the handle assembly and the vibrated screed beam are provided with coupling means which are capable of interacting with one another and which are constructed such that the handle assembly can be fixed to the vibrated screed beam, in such a way that it can be detached therefrom, in a first position or a second position, wherein in the first position the handle assembly slopes upwards obliquely at the first longitudinal side of the vibrated screed beam and wherein in the second position the handle assembly slopes upwards obliquely at the second longitudinal side and in that the first and the second longitudinal side are differently profiled and each has a surface suitable for vibratory levelling. This aim can be achieved by constructing the handle assembly such that it can be fixed on the vibrated screed beam in two different positions, in particular sloping upwards from the one longitudinal side and from the other longitudinal side, and such that it can also be detached again, and providing the vibrated screed beam with a differently profiled surface on its two opposing longitudinal sides. In this context a differently profiled surface can be understood, for example, as a first longitudinal side which is essentially perpendicular to the flat underside and a second longitudinal side which, for example, makes an acute angle of between 45° and 90°, or optionally smaller than 45°, with the flat underside. In this way it is possible for the user, for example depending on his own specific preference, to select the one or the other longitudinal side as the active side, that is to say the side facing the direction in which the vibratory screed device is pulled. Such a preference can even be personal, so that for otherwise identical conditions a different selection is made depending on the person.

According to the invention, however, it is particularly advantageous if the first and the second longitudinal side are provided with mutually different profiles such that they form surfaces which act in a manner which differs from one another. For instance, the one type of profiled surface is particularly suitable for obtaining a scraping-flat action, while the other type of surface is particularly suitable for a smoothing-flat action. In the case of a scraping action, consideration can be given, for example, to the more or less sharp cutting edge at the bottom front of the active longitudinal side frequently required for this purpose. In the case of a smoothing-flat action a sharp cutting edge of this type is frequently not desired since this can give rise to unnecessary plunging of the vibrated screed beam.

According to a further, particular embodiment of the invention, the first longitudinal side is in particular suitable for relatively wet concrete and the second longitudinal side is in particular suitable for relatively dry concrete. It will be clear that the first and the second longitudinal side can also be reversed here. Specifically, the important difference in levelling freshly poured concrete frequently lies in the wetness of the concrete. In the case of very wet concrete the smoothing-flat action is in general the most important and in the case of relatively drier to already substantially dry or possibly even already partially set concrete the scraping action is frequently much more important. With a vibratory screed device of this type it is also conceivable that the concrete is already levelled while relatively wet using the first longitudinal side and subsequently, when the concrete has already set sufficiently or set somewhat and thus has become drier, a further levelling operation, which can also be termed post-levelling is carried out using the second longitudinal side.

If the scraping action is important, it is particularly advantageous according to the invention if the second (or optionally first) longitudinal side has a surface of concave cross-section adjoining the underside. In this way a relatively sharp cutting edge is obtained at the bottom, with an adjoining surface which bends away in the direction opposite to the direction of pulling and then bends back into the direction of pulling, which in combination with the vibration of the vibrated screed beam causes the concrete scraped off to curl up and, in turn, fall back.

According to a further advantageous embodiment, the vibratory screed device according to the invention comprises a first longitudinal side with a surface which adjoins the underside and in cross-section slopes upwards from the underside in the direction of the second longitudinal side. Such a surface which slopes upwards in the direction of the opposing longitudinal side has, as is known per se, a beneficial effect in a smoothing levelling operation and also makes it possible to minimize the vibrated screed beam in respect of its volume and weight. This, in turn, is particularly advantageous in order to obtain a vibratory screed device which can also be operated as a float.

In order to facilitate change-over of the handle assembly between the first and the second position and also to make any replacement of the vibrated screed beam as simple as possible, it is advantageous according to the invention if the vibratory system is fitted on the handle assembly such that it can be detached together with the latter from the vibrated screed beam.

In order also to be able to change over the handle assembly between the first and the second position quickly and without too much effort, it is advantageous according to the invention if the coupling means comprise one or more quick-release couplings.

In order to increase the ease of use, in particular with regard to the change-over between the first and the second position, it is advantageous according to the invention if that part of the coupling means provided on the vibrated screed beam is constructed such that it is mirror-symmetrical with respect to a vertical longitudinal plane. A construction of this type prevents accidental incorrect attachment in the first or the second position or confusion in this respect with regard to the correct manner of attachment.

According to a particular embodiment of the invention, a method of fixing the handle assembly to the vibratory screed device which allows particularly simple attachment and detachment is obtained if the coupling means comprise two male and female systems, the one part of which is always provided at the bottom of the foot of the handle assembly and the other part of which is provided at the top of the vibrated beam on opposing longitudinal sides thereof, the foot of the handle assembly bearing on the top of the vibrated beam when the handle assembly is fixed, and if, with this arrangement, the coupling means further comprise tensioning means by means of which the male and female systems can be clamped into and towards one another under pretension. With adequate clamping, which can be achieved in a simple manner which is obvious as such, a reliable and also simple method of fixing the handle assembly on the vibrated screed beam can thus be achieved. With this arrangement the male and female systems provide, as it were, a positive fit connection. This is in particular highly advantageous if the vibratory system itself is fixed on the handle assembly, since this then has the tendency to want to move the vibrated screed beam with respect to the handle assembly. Optionally, shifting of the handle assembly in the longitudinal direction of the male and female systems, which preferably will run parallel to the longitudinal direction of the vibrated screed beam, can be prevented by the use of a retaining pin.

The vibratory screed device according to the invention can be produced highly advantageously from the standpoint of costs by constructing the vibrated screed beam as a hollow, tubular extruded section, which, in order to keep the weight thereof low, is preferably made of an aluminum or an aluminum alloy. With an extruded vibrated screed beam of this type it is, in particular, also readily possible, and highly advantageous from the standpoint of costs, to form those parts of the male and female systems which are fitted on the vibrated screed beam together with the latter in the extruded section and thus also to extrude them at the same time. In the case of a vibrated screed beam produced as an extruded section, it is particularly advantageous according to the invention if the ends thereof are closed off by means of end caps, the end caps being made rounded without any edges, with radii of curvature of preferably more than 5 mm, the edges coming into contact with the concrete surface preferably even being rounded with a radius of curvature of greater than or equal to 10 mm. In this way it is possible, on the one hand, to prevent there being sharp edges or sides at the ends on which a person could injure him or herself and, on the other hand, to promote the relatively easy removal of concrete residues adhering thereto and, last but not least, also to prevent the ends dragging streaks in the concrete surface to be levelled.

BRIEF DESCRIPTION OF THE DRAWINGS

The present invention will be explained in more detail below with reference to an illustrative embodiment of a vibratory screed device according to the invention which is shown diagrammatically in the drawing. In the drawing.

DETAILED DESCRIPTION OF THE INVENTION

Figure 1:
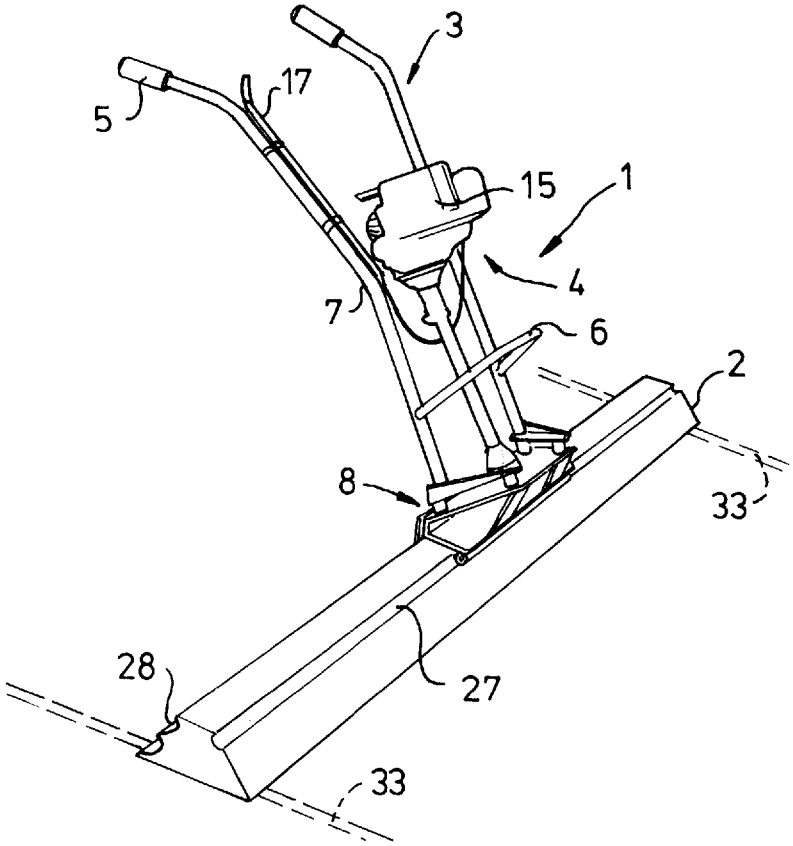
FIG. 1 shows a diagrammatic perspective view of a vibratory screed device according to the invention.

FIG. 1 shows a vibratory screed device, indicated in its entirety by 1. The vibratory screed device 1 consists of a vibrated screed beam 2 with a handle assembly 3 fitted thereon. The vibratory system 4 is, in turn, fitted on the handle assembly 3.

The handle assembly 3 consists of two handles 5 each fitted on a rod 7, which extends from the handle 5 to the bottom of the handle assembly 3, a carrying handle 6 and a foot 8. The foot 8 consists of beam bearing plate 9 for, in particular, bearing flatly on the top of the vibrated screed beam 2, a carrier plate 10, which runs obliquely with respect to the beam plate 9 and which is also fixed to the beam plate 9 and preferably is integral with the latter, and supports 11, by means of which the free, high end of the carrier plate 10 in turn bears on the beam plate 9. It is important that said foot construction 9, 10 and 11 is sufficiently rigid to be able to transmit the vibrations exerted on the carrier plate 10 to the vibrated screed beam 2 without the foot itself starting to vibrate or at least starting to vibrate too much with respect to the vibrated screed beam.

The handle assembly 3 is fixed such that it is damped with respect to the carrier plate by means of rubber blocks 13 and a plate 12 to which the rods 7 are welded. The 10 damped fixing is in order to damp vibrations in the direction of the user holding the handles 5. The rod 14, which is driven by the motor 15, is also fitted on the carrier plate 10, which rod 14 has at its lower end, at 16, an eccentric in order to produce a vibration in the plane of the carrier plate and transversely to the longitudinal direction of the drive shaft 14. The vibratory system 4 will in other respects be equipped such that a vibration in the longitudinal direction of the drive shaft 14 is also produced therewith. The vibrated screed beam 2 will therefore be subjected to vibrations both in the vertical plane and in the horizontal plane.

The vibratory motor 15 can be operated via a control element 17.

The vibrated screed beam 2 has a flat underside 20, a likewise flat top 21, a second longitudinal side 24 and a first longitudinal side 23 which slopes upwards from the flat underside 20 in the direction of the second longitudinal side. The vibrated screed beam 2 has been manufactured as an aluminum extruded section with a horizontal reinforcement 26 and a vertical reinforcement 25 therein. A number of screw locating holes 34 have also been incorporated in the extrusion. The angle $\alpha$ can be, for example, approximately 50°.

The second longitudinal side 24 is provided with a hollow concave surface 25, the bottom of which adjoins the flat underside 20 in order to form a relatively sharp cutting edge at that location.

A concave, hollow groove is formed, in particular co-extruded, on either side at the top of the vibrated screed beam 2. The grooves are indicated by 27 and 28 in FIG. 1. The hollow grooves 27 and 28 form part of the parts of the coupling means arranged on the vibrated screed beam 2.

Further coupling means 29 and 30 which are made in a correspondingly convex shape and belong to the handle assembly fit in the hollow grooves 27 and 28. The coupling means 30, shown here as a cylindrical tube, are fixed, for example welded to or coextruded with the beam plate 9. In the illustrative embodiment shown here, the convex coupling means 29 essentially consist of half of a cylinder having a body integrally formed therewith which extends upwards and is provided with bolt passages through which bolts 31 can be inserted, in order to be able to fix the coupling means 29 to the foot 8 by means of wing nuts 32 or other quick-release coupling means or optionally ordinary hexagonal nuts. It will be clear that the concave-convex groove 28 and the cylinder 30 form a male and female system and that the concave-convex groove 27 and the convex element 29 also form a male and female system and that said male and female systems are clamped into one another by tightening the wing nut 32.

Figure 2:
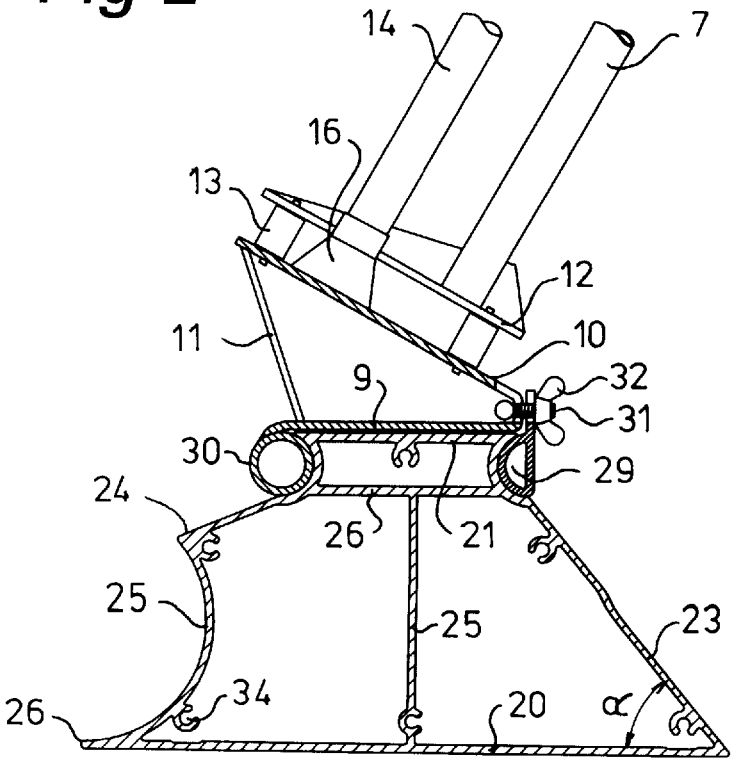
FIG. 2 shows a cross-sectional view of a vibrated screed beam and the foot of the handle assembly, the handle assembly being fixed in a different position compared with that in FIG. 1.

In particular from FIG. 2 it will be clear that the foot 8 can also be fitted on the vibrated screed beam turned through 180° about a vertical line, as is then also shown in FIG. 1.

It will also be clear that the vibratory screed device according to the invention can be used both for so-called floating operation, in which the vibrated screed beam as it were floats on the freshly poured concrete surface, and for operation travelling over forms, as is indicated by means of forms 33 shown by broken lines in FIG. 1.

What is claimed is:

1. A vibratory screed device for levelling freshly poured concrete surfaces, comprising:

an elongated vibrated screed beam delimited by a flat underside, a first longitudinal side, a second longitudinal side, and a top;

a vibratory assembly for bringing the vibrated screed beam into vibration; and a handle assembly adapted to be detachably fixed to the vibrated screed beam at an upward slope with respect to the flat underside and substantially transversely to the vibrated screed beam;

the handle assembly and the vibrated screed beam including coupling elements which are structured and arranged to interact with one another, such that the handle assembly is detachably fixable to the vibrated screed beam in a first position of operation, as well as detachably fixable in a second position of operation; wherein in the first position, the handle assembly slopes upwards obliquely at the first longitudinal side of the vibrated screed beam, and in the second position the handle assembly slopes upwards obliquely at the second longitudinal side; the first longitudinal side having a first profile; the second longitudinal side having a second profile; and said first profile being different from said second profile.

2. The vibratory screed device according to claim 1, wherein the second longitudinal side has a surface of concave cross-section adjoining the underside.

3. The vibratory screed device according to claim 1, wherein the first longitudinal side comprises a surface which adjoins the underside and in cross-section slopes upwards from the underside in the direction of the second longitudinal side.

4. The vibratory screed device according to claim 1, wherein the vibratory assembly is fitted on the handle assembly such that the vibratory assembly is adapted to be detached together with the handle assembly from the vibrated screed beam.

5. The vibratory screed device according to claim 1, wherein a part of the coupling elements provided on the vibrated screed beam is constructed such that it is mirror-symmetrical with respect to a vertical longitudinal plane.

6. The vibratory screed device according to claim 5, wherein the handle assembly comprises a handle and a foot; said coupling elements comprising two male and female systems; one part of said male and female systems being provided at the bottom of the foot of the handle assembly, and another part of said male and female systems being provided at the top of the vibrated screed beam on opposing longitudinal sides thereof; the foot of the handle assembly bearing on the top of the vibrated screed beam when the handle assembly is fixed; and said coupling elements further comprising tensioning means for clamping the male and female systems into and towards one another under pretension.

7. The vibratory screed device according to claim 1, wherein the vibrated screed beam comprises a hollow extruded profile made of aluminum or aluminum alloy.

8. The vibratory screed device according to claim 7, further comprising end caps for closing off ends of the vibrated screed beam; the end caps being rounded without any edges, and having a radii of curvature of more than 5 mm.

* * * * *